United States Patent [19]

Roslyng et al.

[11] 4,055,994

[45] Nov. 1, 1977

[54] METHOD AND A DEVICE FOR DETECTING THE STALL CONDITION OF AN AXIAL FLOW FAN OR COMPRESSOR

[75] Inventors: Ole Roslyng; Niels Erik Friis Dam, both of Naestved, Denmark

[73] Assignee: Nordisk Ventilator Co., A/S, Naestved, Denmark

[21] Appl. No.: 713,958

[22] Filed: Aug. 12, 1976

[30] Foreign Application Priority Data

Aug. 12, 1975 Denmark ..... 3656/75
Feb. 10, 1976 Denmark ..... 531/76

[51] Int. Cl.[2] ..... G01M 15/00

[52] U.S. Cl. ..... 73/116; 73/168; 340/27 SS

[58] Field of Search ..... 73/115, 116, 117.3, 73/117.4, 168; 60/223; 340/27 SS; 415/118

[56] References Cited

U.S. PATENT DOCUMENTS 3,677,000 7/1972 Thomson ..... 60/39.28 R
3,886,790 6/1975 Plett ..... 73/117.4
3,935,558 1/1976 Miller et al. ..... 340/27 SS
3,938,319 2/1976 Thomson ..... 73/115 X

*Primary Examiner*—Charles A. Ruehl
*Attorney, Agent, or Firm*—Sughrue, Rothwell, Mion, Zinn and Macpeak

[57] ABSTRACT

The stall condition occurring in the unstable working range of an axial flow fan or compressor arranged in an air duct is detected by measuring the pressure difference between the total air pressure acting in a direction opposite to the direction of revolution of the fan wheel and a reference pressure corresponding substantially to the static pressure at the wall of the air duct in the same radial measuring plane. The detector device comprises first and second pressure measuring probes of an open tubular configuration for measuring said total pressure and reference pressure, respectively, and means for detecting the difference between the pressure values measured thereby, said probes being designed and arranged in the air duct so that the flow conditions around them are equal in the stable working range of the fan or compressor.

10 Claims, 16 Drawing Figures

METHOD AND A DEVICE FOR DETECTING THE STALL CONDITION OF AN AXIAL FLOW FAN OR COMPRESSOR

The present invention relates to a method and a device for detecting the stall condition of an axial flow fan or compressor arranged in an air duct.

BACKGROUND OF THE INVENTION

In the normal stable working range of an axial flow fan all vane channels between the fan blades are flown through equally and continuously by the air volume transported by the fan.

However, in the unstable working range a stall condition arises in the form of great pressure variations as a result of which the fan blades may be subjected to severe damage or even destruction when operating in this working range for some time. Therefore, operation in this unstable working range should be avoided and usually such working conditions for an axial flow fan are aimed at that the fan will operate in the stable working range only.

The pressure variations occurring in the unstable or stalling range express themselves by the creation of one or more zones in which the air flow through the vane channels is blocked or goes in the opposite direction and it has been shown that such stalling zones move around the fan wheel with an angular velocity smaller than the rotational speed of the wheel.

In an article by Hartwig Petermann in the German periodical "Stahl und Eisen", No. 9, Apr. 27, 1961 pages 589 to 593 and in German published patent application (DAS) No. 1,232,310 it has been suggested to utilize the latter recognition to detect the stall condition of an axial flow fan by measuring the total air pressure in a direction opposite to the direction of revolution of the fan wheel in a radial measuring plane immediately in front of the fan blades relative the atmospheric pressure by means of a hook-shaped tubular measuring probe. It has been shown that a curve representing this relative pressure as a function of the air volume transported by the fan has a characteristic knee at the junction between the stable working range and the stalling range in the fan characteristic so that such a measurement will be suitable for detecting the arise of the stall condition.

However, this known method suffers from the limitation that it is only applicable in connection with axial flow fans having stationary, i.e. non-adjustable vanes and rotating at a constant speed and in such cases where control members in the form of dampers or the like are not installed in the air duct on the suction side of the fan. Thus, if control dampers are present, the static pressure in the measuring plane and, as a result thereof, also the pressure value associated with said knee on the detector characteristic will unavoidably be changed so that said knee will no longer be detectable by a conventional pressostat and the known method will not be suitable for supervision and control of axial flow fans of this kind in order to prevent them from entering into the stall condition.

SUMMARY OF THE INVENTION

It is the object of the invention to remove the inherent limitations of the prior art method referred to above and provide a novel method and device for reliably detecting when an axial flow fan enters from its stable working range into the stall condition.

According to the invention, a method is provided for detecting the stall condition of an axial flow fan or compressor arranged in an air duct, comprising the step of measuring the pressure difference between the total air pressure acting in a direction opposite to the direction of revolution of the fan wheel and a reference pressure corresponding substantially to the static pressure at the wall of the duct in substantially the same radial measuring plane.

Thereby, the pressure value associated with the knee on the detector characteristic will be constant for constant vane pitch and constant rotational speed of the fan, so that entrance into the stall condition will be accurately detected independent of the presence of control dampers in connection with the air duct.

In its simplest form the method according to the invention can be carried out by measuring, in addition to the measurement of the pressure acting opposite to the direction of revolution of the fan, the said reference pressure and detect the difference between the pressure values thus measured.

However, in axial flow fans the vanes of which are adjustable during operation or fans the rotational speed of which is adjustable the problem occurs that the flow rate at the point of entrance of the fan into the stall condition will depend on the adjusted pitch or rotational speed, respectively. If the method according to the invention is carried out by means of a hook-shaped probe of the kind disclosed in the article referred to above the flow conditions around the pitch opening will be influenced by the probe itself as a result of the form thereof, whereby an under pressure will arise in the stable working range of the fan. In case of adjustable fans of the kinds mentioned above the result thereof will be that the detection of the pressure difference in accordance with the invention will show a smaller, i.e. more negative value of said pressure difference with increasing air flow rate and volume.

Therefore, it is a further object of the invention to remove this disadvantage and provide a further improvement of the detecting method so that entrance into the stall condition can be detected with reliability and accuracy also for adjustable fans.

To accomplish this the invention provides in addition to the above-mentioned method, a device for detecting the stall condition of an axial flow fan or compressor arranged in an air duct comprising first and second pressure measuring probes of an open tubular configuration for measuring the total air pressure acting in a direction opposite to the direction of revolution of the fan wheel and a reference pressure corresponding substantially to the static pressure at the wall of the duct in substantially the same radial measuring plane, respectively, which probes are designed and arranged in the air duct so that the flow conditions around them are equal in the stable working range of the fan; and means for detecting the difference between the pressure values measured by said probes.

When using this detector device the resulting pressure difference will be approximately zero in the stable working range of the fan independent of the adjustment of the vane pitch or rotational speed thereof, but increases remarkably corresponding to a knee on the pressure difference characteristic when the fan enters into the stall condition. Thereby, the stall condition can be detected reliably and accurately by means of a simple differential pressostat.

BRIEF DESCRIPTION OF THE DRAWINGS

The invention will be explained in further detail in the following with reference to the schematical drawings wherein.

DETAILED DESCRIPTION

Figure 1:
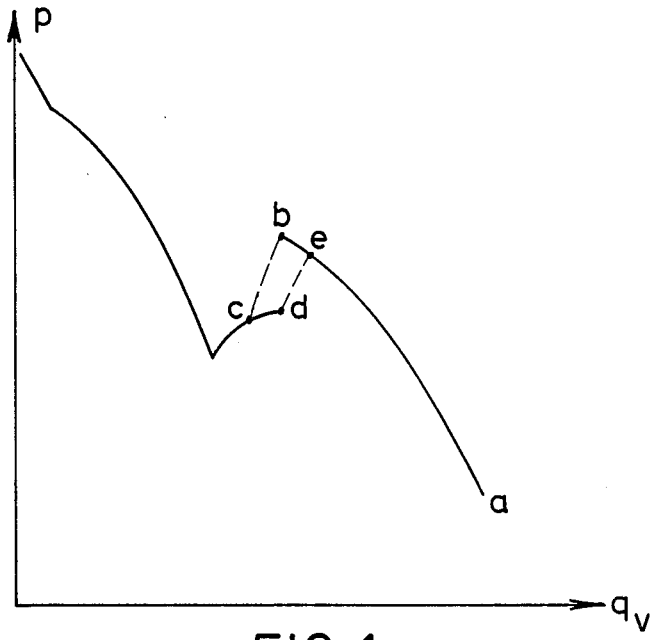
FIG. 1 is a graphic representation of the characteristic of an axial flow fan.

FIG. 1 shows a typical characteristic diagram of an axial flow fan in the form of a graphic representation of the pressure difference $p$ between the suction side and the pressure side of the fan as a function of the transported air volume Qv. The curve portion *a–b* indicates the normal or stable working range of the fan in which the air volume decreases gradually with increasing counter pressure until the point *b* at which the pressure as well as the air volume suddenly drop to a point *c*. This is the condition referred to as stalling and, in the same manner as in the case of an aeroplane wing, the stalling phenomenon results from the fact that the air flow around the vane profile will only follow the surface of the profile as long as the angle of incidence of the air flow relative to the longitudinal axis of the vane profile is below a critical value, which depends on the profile shape. When the angle of incidence reaches this critical value the air flow will suddenly escape from the convex side of the profile, whereby strong vortices will arise at this side simultaneously with the occurrence of a considerable pressure drop. If the counter pressure begins to increase, the air volume will initially increase to the point *d* at which it will suddenly change to the point *e* and simultaneously the stall condition will again cease to exist.

In order to prevent operation of the fan in this unstable working range of its characteristic with the resulting risk of breakage in the fan vanes it is prescribed that axial flow fans should be operated within the curve portion *a–e*, in which all the vane channels between the fan vanes are uniformly and continuously flown through by the transported air volume.

Figure 2:
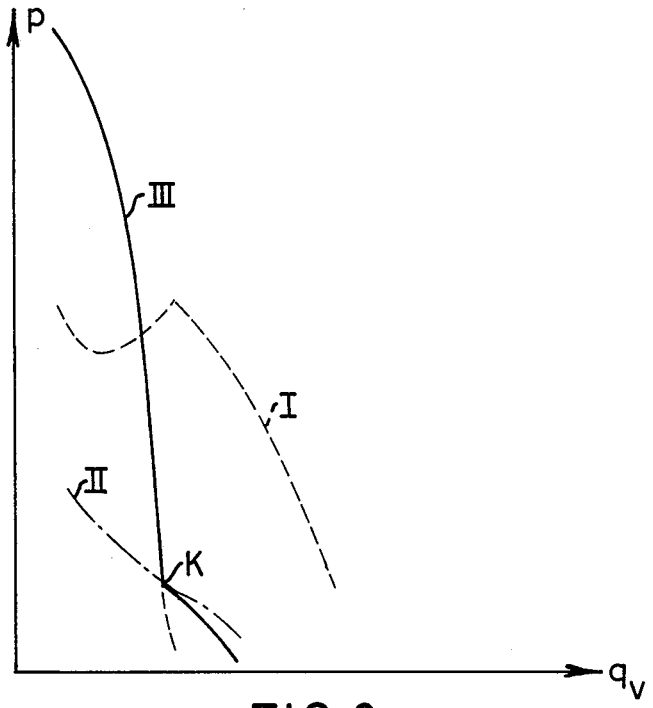
FIG. 2 is a graphic illustration of a known method for detecting the stall condition of an axial flow fan.

FIG. 2 is a graphic representation illustrating the method for detecting the entrance into the stall condition disclosed in the article mentioned in the foregoing and in German published specification (DAS) No. 1,232,310. The dotted curve I corresponds to the fan characteristic shown in FIG. 1 and represents the static pressure difference across the fan, while the dot-and-dash-curve II shows the static pressure at the wall of the air duct in a plane immediately in front of the fan vanes and the solid curve III indicates the difference between the total pressure acting in the same plane in a direction opposite to the direction of revolution of the fan and the atmospheric pressure. As mentioned hereinbefore, the detecting method suggested in the article prescribes the measuring of the pressure acting in the direction opposite to the direction of revolution in a radial plane immediately in front of the fan vanes as represented by the curve III in FIG. 2, since this pressure curve exhibits a characteristic knee at the junction between the stable working range in the fan characteristic and the stalling range. However, this known method will be suitable only in connection with axial flow fan having non-turnable vanes and operating at a constant rotational speed and wherein no control devices such as a damper are installed in the air duct on the suction side of the fan. In the presence of control dampers, the position of the curve II in FIG. 2 will be displaced and together therewith the position of the characteristic knee on the curve III.

By the method according to the invention this limitation is removed by making the measurement as a measurement of the difference between said total pressure acting in direction opposite to the direction of revolution of the fan and a reference pressure at the wall of the air duct in substantially the same radial measuring plane in front of the fan vanes, i.e. approximately the difference between curves III and II in FIG. 2. Thereby, a resulting curve will be obtained as shown at A in FIG. 3 on which the position of the knee K is no longer influenced by the presence of any control members in the air duct on the suction side of the fan, and as a result thereof the measuring method is made suitable for supervising and controlling axial flow fans for the purpose of preventing stalling.

Figure 4:
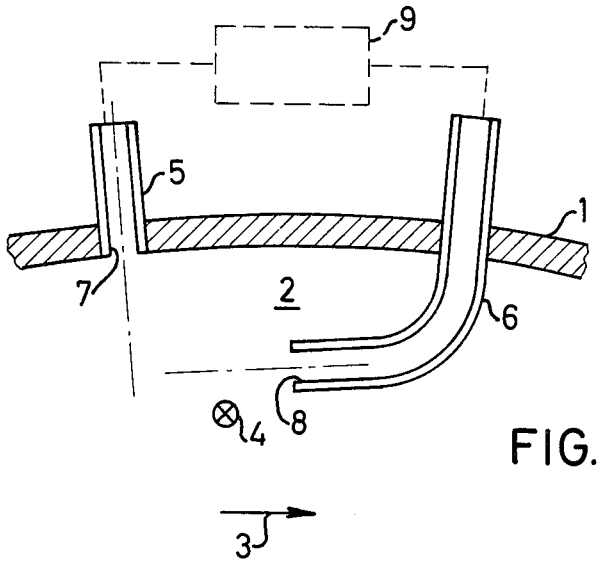
FIG. 4 shows a first embodiment of a device according to the invention for performing the method illustrated in FIG. 3.

The measurement may be carried out by means of a device as schematically shown in FIG. 4, which shows a portion of a wall 1 of an air duct 2 in which an axial flow fan not shown in the figure is arranged with a direction of revolution as indicated by an arrow 3, while the direction of the air flow in the stable working range of the fan is indicated by an arrow symbol 4. Two pressure measuring probes 5 and 6 of a tubular configuration are led through duct wall 1 and have probe openings 7 and 8, respectively, the axes of which extend in substantially the same radial plane relative to the air duct and are directed towards the central, longitudinal axis of the duct and in direction perpendicular thereto, respectively. As schematically indicated by dotted lines, the pressure measuring probes 5 and 6 may be connected to a differential pressostat 9.

In a very simple embodiment as illustrated in FIG. 4 the probe 5 intended to measure the reference pressure in the measuring plane referred to, consists of a rectilinear tube piece with the probe opening arranged co-planar with the inner side of duct wall 1, while probe 6 is constituted by a tube piece bent into hook-shape as prescribed by the measuring method disclosed in German published specification (DAS) No. 1,232,310.

When measuring by means of the device shown schematically in FIG. 4 by which the pressure is measured as the difference between the pressure measured by the hook-shaped probe 6 and the reference pressure measured by probe 5 the influence of variations in the reference pressure and, thus, in the static pressure is eliminated so that the position of knee K on the measuring characteristic is independent on the presence of control devices, such as dampers, on the suction side of the fan installed in the air duct, said knee K being furthermore more pronounced than in case of the method disclosed in the article menntioned hereinbefore.

Figure 3:
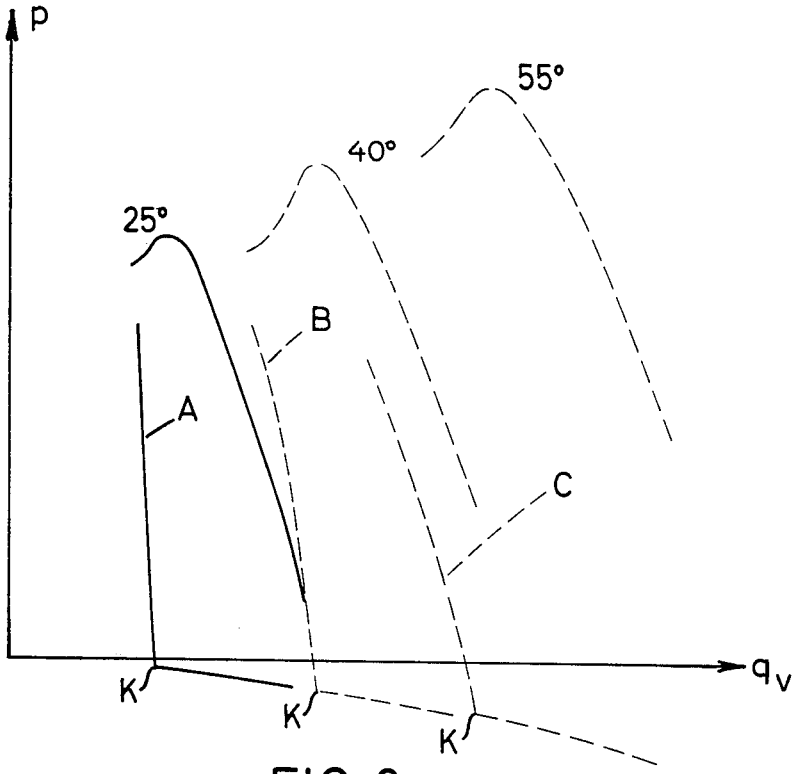
FIG. 3 is a graphic representation illustrating the detection of the stall condition by means of the method according to the invention.

However, due to the shape of the measuring probes the device shown in FIG. 4 will only be suitable for use in connection with axial flow fans having non-turnable vanes and operating at a constant rotational speed. In case of axial flow having vanes which are adjustable during operation or the rotational speed of which is adjustable, the flow rate at the point of the fan characteristic, at which the fan enters into the stall condition, will depend on the pitch adjustment of the fan vanes or the rotational speed, respectively. In FIG. 3, this relationship is illustrated for an axial flow fan having vanes which are adjustable during operation, by two dotted curve sets B and C corresponding to pitch adjustments different from that of curve A. Thus, in the illustrated example curve A corresponds to a pitch setting of 25°, while curves B and C correspond to pitch settings of 40° and 55°, respectively. It will be immediately apparent that the change of the pitch setting results in a displacement of the position of knee K on the measuring characteristic in a negative direction equivalent to a decrease of the differential pressure detected in the point of entering into the stall condition towards smaller values for increasing flow rate and transported air volume. Together with each of curves A, B and C figure 3 shows the corresponding fan characteristics for the above-mentioned pitch adjustments of 25°, 40° and 55°, respectively.

The above-mentioned displacement of the knee on the measuring characteristic is due to the fact that when measuring in the stable working range of the fan characteristic the measuring probe illustrated at 6 in FIG. 4 and prescribed by the method disclosed in the article mentioned hereinbefore, said probe having the form of a hook-shaped tube piece and serving to measure the pressure against the direction of revolution of the fan wheel, will be influenced not only by the static pressure in the measuring plane, but due to its shape also by the dynamic pressure, so that an under pressure is created in the probe.

According to the invention this limiting factor in the use of the measuring device can be removed by designing the probes so that the flow conditions around them are equal when they are arranged in front of a fan and this fan operates outside the stalling range.

Figure 5:
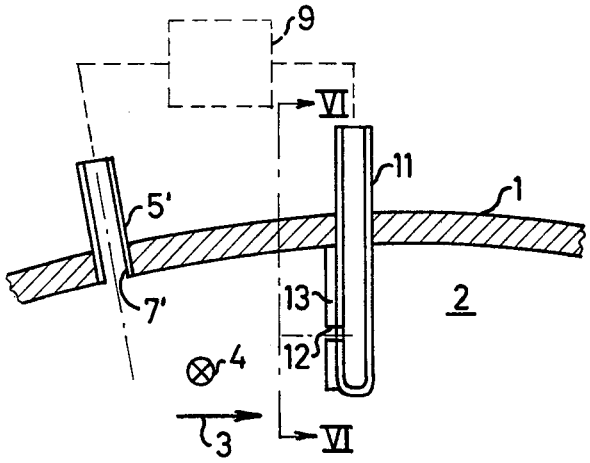
FIG. 5 shows a further development of the device according to the invention.
Figure 6:
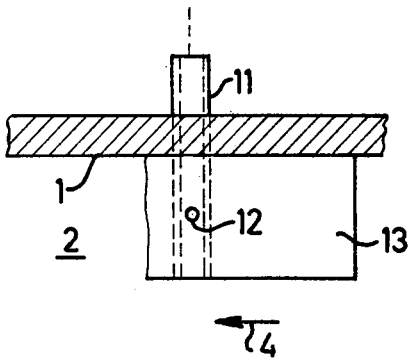
FIG. 6 is a sectional view along the line VI—VI in FIG. 5.

A very simple embodiment of such a device is shown in FIGS. 5 and 6 showing a radial plane of a fan duct in the same manner as FIG. 4 and an axial sectional view, respectively. Also in this case the rectilinear measuring probe 5' serving to measure the reference pressure has a probe opening 7' co-planar with the inner side of duct wall 1. However, instead of the hook-shaped probe 6 in FIG. 4 a probe 11 is used to measure the pressure against the direction of revolution of the fan wheel having a probe opening 12 positioned in a guiding plate 13 arranged parallel to the direction of the air flow, in this case the axial direction of air duct 2. In the embodiment shown in FIGS. 5 and 6 the tubular measuring probe 11 is rectilinear and closed at its free end projecting into air duct 2, while the probe opening has been made in the side wall of said tube piece.

Figure 7:
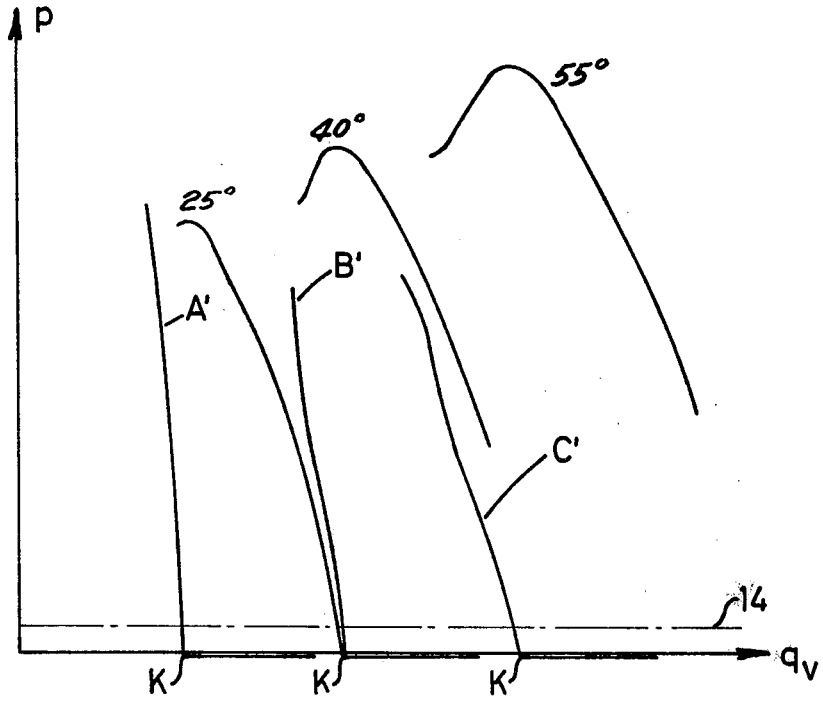
FIG. 7 is a graphic representation illustrating the detection of the stall condition by means of the device shown in FIGS. 5 and 6.

In a measuring device as shown in FIGS. 5 and 6 the flow conditions around probes 5' and 11 will be equal when the fan operates in its normal working range outside the stalling range so that the probes are not sensitive to the flow rate. In this case, the curves A, B and C in FIG. 3 corresponding to pitch settings of 25°, 40° and 55° will change to the curves A', B' and C' shown in FIG. 7, in which the position of the knee K on the measuring characteristic is independent on the pitch setting. As a result hereof, the device and method according to the invention will be applicable for supervision purposes to prevent entrance of an axial flow fan into the stall condition by incorporating differential pressostat 9, which constitutes the detecting means of the device and the response threshold of which is indicated in FIG. 7 by a dot-and-dash-line 14, into a control circuit by which the adjusting means for the pitch setting of the fan vanes are influenced in such a way that the fan is caused to close its wings slowly when entering into the stall condition and is thereby returned to a working range in which the stall condition ceases. In FIG. 7 fan characteristics corresponding to the above-mentioned pitch settings of 25°, 40° and 55°, respectively, are shown in the same manner as in FIG. 3.

Figure 8:
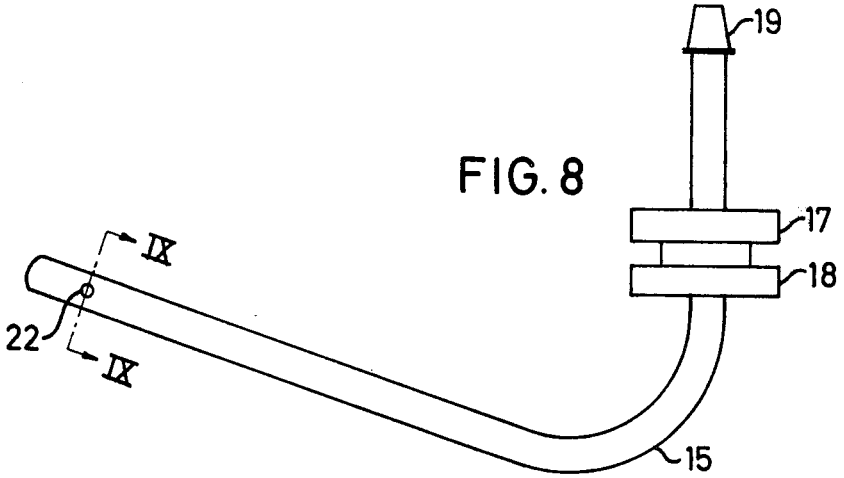
FIGS. 8 to 11 show a second embodiment of the device according to the invention for performing the method illustrated in FIG. 7.
Figure 9:
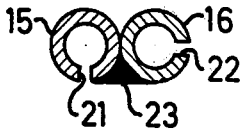
Figure 10:
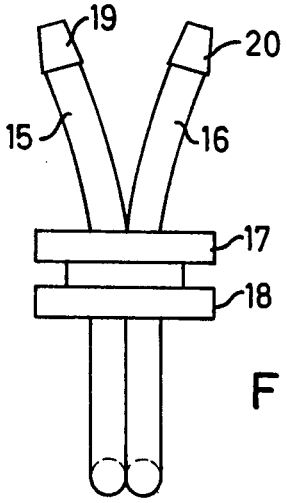
Figure 11:
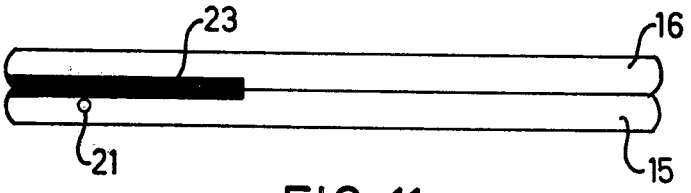

In FIGS. 8 to 11 a practically preferred embodiment of the device according to the invention is shown. In this device the two tubular measuring probes are constituted by bent tube pieces 15 and 16, which are assembled in a fitting 17 for mounting the device in a bore of a duct wall by means of a nut 18. The portion of each tube piece intended to be positioned outside the duct is provided with a hose attachment 19 and 20, respectively, for the attachment of a connecting hose, not shown, from a detecting means such as the differential pressostat 9 in FIGS. 4 and 5. The portions of the tube pieces disposed inside the duct are closed at their free ends and extend rectilinearly with parallel axes side by side in the axial direction of the duct. Near the closed ends of tube pieces 15 and 16 probe openings 21 and 22, respectively, are formed in the same radial plane therein, the axes of said openings being perpendicular to each other as shown in FIG. 9, so that with the device mounted in the air duct one opening 21 faces the longitudinal axis of the duct, while the other faces a direction opposite to the direction of revolution of the fan. Moreover, said parallel portions of tube pieces 15 and 16 are assembled on part of their length around the probe openings in such a way that a planar guiding surface is provided between the tube pieces corresponding to guiding plate 13 in FIGS. 5 and 6. This guiding surface may be obtained by means of a filling 23 in the form of a soldering joint, for instance, between the tube pieces 15 and 16 and limited on the side of probe opening 21 by a tangential plane of tube pieces 15 and 16.

Figure 12:
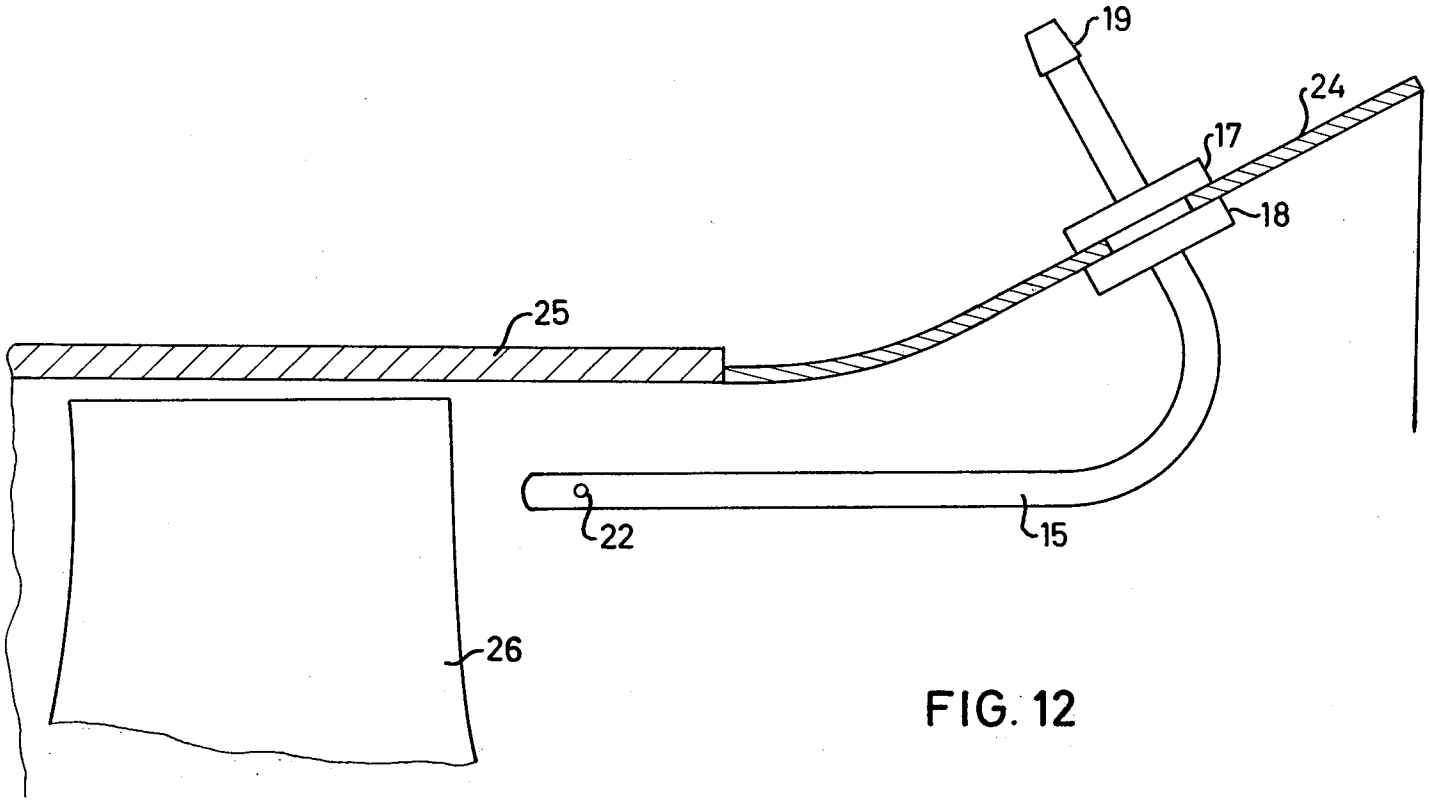
FIG. 12 shows an example of the installation of the device shown in FIGS. 8 to 11 in co-operation with an axial flow fan arranged in an air duct.

FIG. 12 shows an example of the installation of the embodiment of the device according to the invention shown in FIGS. 8 to 11 in a suction funnel 24 of an air duct 25 in which an axial flow fan is arranged as illustrated by a single fan vane 26. It will appear that the bending angle for the assembled tubular probes will be determined by the form of the wall of an air duct or suction funnel in which the probes are to be secured so that this bending angle will have to be adjusted in accordance with the actual use of the probes in such a manner that the assembled rectilinear parts of the probes inside the duct will extend parallel to the axis thereof. Practical experiments have shown that the length of said rectilinear parts of the tubular probes should be at least 90 mms and that the filling 23 around the probe openings intended to form a guiding surface in the axial direction of the duct, which filling will be most clearly apparent from the illustration in FIG. 11 of the under side of the assembled probes, should have a length of at least 30 mms. When mounted in the suction funnel of the air duct the two tubular probes of the device are positioned as close to the front edges of fan wings 26 as possible, the distance from said wings being, however, preferably at least 10 mms at full open wings. The probes may be arranged at a distance of about 15 to 20 mms, for instance, from the innerside of the duct wall surrounding the fan.

Figure 13:
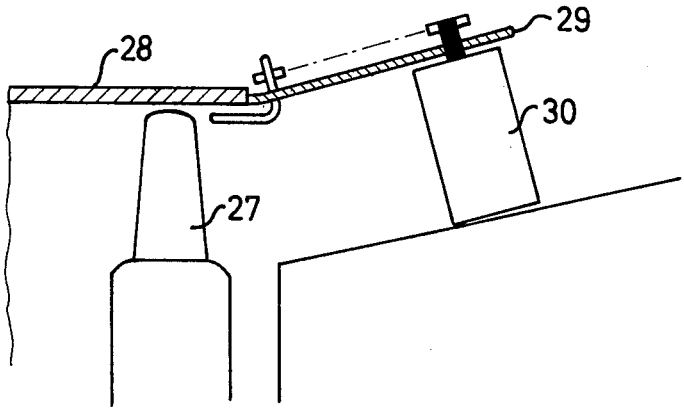
FIG. 13 shows an example of the installation of the device shown in FIGS. 8 to 11 in co-operation with an axial flow fan equipped with a pre-guiding device.

In FIG. 13 a further example is shown illustrating the application of a stall measuring device according to the invention in the embodiment shown in FIGS. 8 to 11 in cooperation with an axial flow fan 27 arranged in an air duct 28, wherein a pre-guiding device comprising rotatable guide vanes 30 is arranged in a suction funnel 29 on the suction side of the fan. In this application the assembled tube pieces of the device are mounted to be rotatably journalled in the wall of the duct or suction funnel and they are mechanically coupled with means for turning the guide vanes so that they will always be adjusted in parallel relationship to the actual direction of the incoming air flow.

Figure 14:
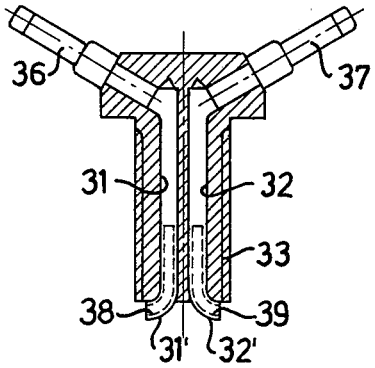
FIG. 14 shows a further embodiment of a device for performing the method illustrated in FIG. 7.
Figure 16:
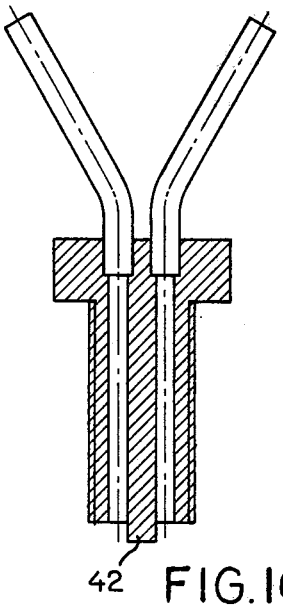
FIG. 16 shows a still further embodiment of the device according to the invention.
Figure 15:
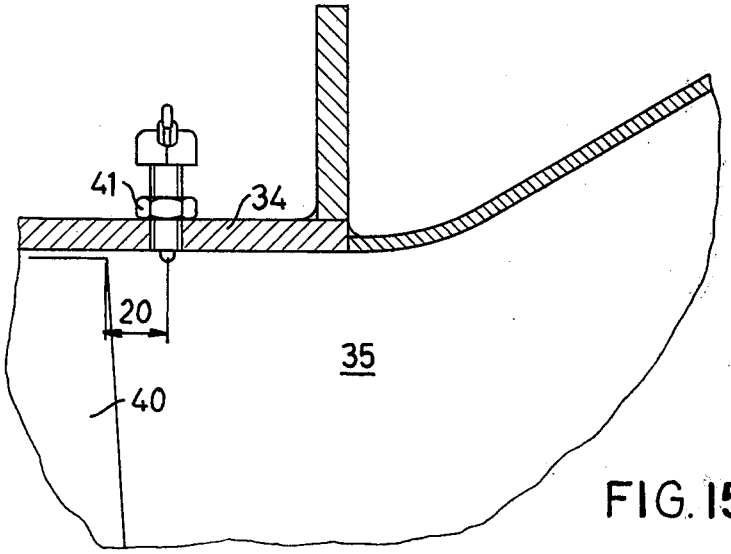
FIG. 15 shows the installation of such a device in an air duct in front of an axial flow fan.

In the embodiments shown in FIGS. 14 and 16 the probes conist of two substantially rectilinear channels 31 and 32 which are formed in a common fitting 33 having an external threading to be screwed directly into the wall 34 of an air duct 35 such as shown in FIG. 15. In the same manner as shown in FIGS. 8 and 9 the portion of each channel 31 and 32 intended to be positioned outside wall 34 is connected with a hose attachment 36 and 37, respectively, for hose connections not shown from a detecting means such as a differential pressostat. The orifices of channels 31 and 32 at the end of fitting 33 positioned inside air duct 35 are separated from each other, so that the orifice of one channel is influenced mainly by the static pressure only, intended to serve as a reference pressure, while the orifice of the other channel is influenced mainly by the total pressure only, which acts in a direction opposite to the direction of revolution of the fan wheel.

In the embodiment shown in FIG. 14 the separation between the orifices of channels 31 and 32 is obtained by means of relatively short tube pieces 31' and 32', respectively, inserted in each of said channels and bent substantially through 90° to point away from each other.

As seen in FIG. 15 the fitting 33 is arranged so that probe orifices 38 and 39 are positioned immediately inside duct wall 34 with their axes extending in longitudinal extension of each other perpendicular to the direction of the incoming air flow, which in this example is parallel to the longitudinal axis of air duct 35, the probes being furthermore arranged at a distance of 20 mms, for instance, in front of fan vanes 40 in the fully open condition of these vanes.

Subsequent to having been screwed into the duct wall in this manner the fitting 33 is secured by means of a counter nut 41.

In the modification shown in FIG. 16 the separation between the orifices of channels 31 and 32 is obtained by means of a partition 42 provided at the end of fitting 33 positioned in air duct 35, the orifices of the channels being provided directly in the end face of the fitting.

The device shown in FIG. 16 is arranged in the duct wall 34 in the same manner as shown in FIG. 15 and with such an orientation that partition 42 is parallel to the direction of the incoming air arriving at fan vanes in the stable working range of the fan, said direction being parallel to the longitudinal axis of air duct 35 in the present example.

What is claimed is:

1. A method of detecting the stall condition of an axial flow fan or compressor arranged in an air duct, comprising the step of measuring the pressure difference between the total air pressure acting in a direction opposite to the direction of revolution of the fan wheel and a reference pressure corresponding substantially to the static pressure at the wall of the duct in substantially the same radial measuring plane.

2. A device for detecting the stall condition of an axial flow fan or compressor arranged in an air duct comprising first and second pressure measuring probes of an open tubular configuration for measuring the total air pressure acting in a direction opposite to the direction of revolution of the fan wheel and a reference pressure corresponding substantially to the static pressure at the wall of the duct in substantially the same radial measuring plane, respectively, which probes are designed and arranged in the air duct so that the flow conditions around them are equal in the stable working range of the fan, and means for detecting the difference between the pressure values measured by said probes.

3. A device as claimed in claim 2, wherein said first probe is designed to be arranged in said duct with its opening positioned directly in the wall thereof whereas said second probe is provided with a guiding surface around its opening and designed to be arranged in the duct with said guiding surface parallel to the flow direction therein.

4. A device as claimed in claim 2, wherein said first and second probes are made up of two tubular members extending through the duct wall and being bent inside the duct to extend side by side in the flow direction of the air supplied to the fan to terminate at free closed tube ends at which said probe openings are positioned in the same radial plane in the wall of either one of said members.

5. A device as claimed in claim 4, wherein said tubular members on part of their length from said closed tube ends are assembled to form a planar guiding surface between said members.

6. A device as claimed in claim 5, wherein said guiding surface is formed by a filling in the space between said tubular members limited by a tangential plane to said members.

7. A device as claimed in claim 4, for detecting the stall condition of an axial flow fan arranged in an air duct in combination with an adjustable pre-guiding device with turntable guide vanes to change the flow direction of the air supplied to the fan, wherein said tubular members are rotatably supported in the duct wall and coupled mechanically to said adjustable pre-guiding device to be turnable together with the guide vanes thereof to secure parallel relationship relative to said flow direction.

8. A device as claimed in claim 2, wherein said first and second probes are made up of two substantially parallel channels extending in a common fitting designed to be mounted in the wall of said duct with the probe openings positioned immediately inside the duct wall and separated from each other so that the opening of the second probe is influenced substantially by said reference pressure only, while the opening of the first probe is influenced substantially by said total pressure only.

9. A device as claimed in claim 8, wherein the separation between said probe openings is obtained by means of relatively short tubular members arranged in each of said channels and bent inside the air duct through an angle of substantially 90°.

10. A device as claimed in claim 8, wherein the separation between said probe openings is obtained by means of a partition formed between the openings of said channels at the end of said fitting.

* * * * *

UNITED STATES PATENT AND TRADEMARK OFFICE

CERTIFICATE OF CORRECTION

PATENT NO. : 4,055,994

DATED : Nov. 1, 1977

INVENTOR(S) : Ole Roslyng et al

It is certified that error appears in the above-identified patent and that said Letters Patent are hereby corrected as shown below:

In the Abstract lines 4 and 5, after "pressure acting in" delete [a direction opposite to]

Column 1, lines 36-37 after "air pressure in" delete [a direction opposite to]

Column 2, line 5, after "pressure acting in" delete [a direction opposite to]

Column 2, line 18, after "pressure acting" delete [opposite to] and insert ---- in ----

Column 2, lines 50-51, after "pressure acting in" delete [ a direction opposite to]

Column 4, lines 14-15, after "in the same plane in" delete [a direction opposite to]

Column 4, lines 18-19 after "pressure acting in" delete [the direction opposite to]

UNITED STATES PATENT AND TRADEMARK OFFICE

CERTIFICATE OF CORRECTION

PATENT NO. : 4,055,994

DATED : Nov. 1, 1977

INVENTOR(S) : Ole Roslyng et al

It is certified that error appears in the above-identified patent and that said Letters Patent are hereby corrected as shown below:

Column 4, line 36, after "acting in" delete direction opposite to

Column 5, line 50, after "pressure" delete [against] and insert --- in ---

Column 5, line 68, delete [against] and insert --- in ---

Column 7, line 51, after "acts in" delete "a direction opposite to]

Column 8, line 20-21 after "acting in" delete [a direction opposite to]

Column 8, line 29, after "pressure acting in" delete [a direction opposite to]

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*